US011079099B2

(12) United States Patent
Feit et al.

(10) Patent No.: US 11,079,099 B2
(45) **Date of Patent: *Aug. 3, 2021**

(54) LED LIGHTING FIXTURE

(71) Applicant: Feit Electric Company, Inc., Pico Rivera, CA (US)

(72) Inventors: Alan Barry Feit, Encino, CA (US); Brian Halliwell, Pico Rivera, CA (US)

(73) Assignee: Feit Electric Company, Inc., Pico Rivera, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/896,861

(22) Filed: Jun. 9, 2020

(65) Prior Publication Data

US 2020/0332994 A1 Oct. 22, 2020

Related U.S. Application Data

(63) Continuation of application No. 16/545,767, filed on Aug. 20, 2019, now Pat. No. 10,711,991, which is a (Continued)

(51) Int. Cl.

| | |
|---|---|
| ***F21V 8/00*** | (2006.01) |
| ***F21V 29/70*** | (2015.01) |
| *F21Y 115/10* | (2016.01) |
| *F21S 8/00* | (2006.01) |
| *F21S 8/06* | (2006.01) |

(Continued)

(52) U.S. Cl.

CPC ..... *F21V 29/70* (2015.01); *F21S 8/036* (2013.01); *F21S 8/065* (2013.01); *F21W 2121/00* (2013.01); *F21W 2131/10* (2013.01); *F21W 2131/40* (2013.01); *F21Y 2115/10* (2016.08); *Y10T 29/49002* (2015.01)

(58) Field of Classification Search

CPC ..... F21S 8/063; F21S 8/065; F21V 29/70; F21V 29/22

See application file for complete search history.

(56) References Cited

U.S. PATENT DOCUMENTS

| | | |
|---|---|---|
| 7,063,441 B2 | 6/2006 | Kramer et al. |
| 7,559,674 B2 | 7/2009 | He et al. |

(Continued)

OTHER PUBLICATIONS

U.S. Appl. No. 16/545,767, filed Aug. 20, 2019, U.S. Pat. No. 10,711,991, Patented.

(Continued)

*Primary Examiner* — Karabi Guharay

(74) *Attorney, Agent, or Firm* — Alston & Bird LLP

(57) ABSTRACT

Embodiments of the present invention provide a light emitting diode (LED) lighting fixture and methods of manufacturing the same. In various embodiments, the LED lighting fixture comprises a lighting fixture body and one or more luminaires. The one or more LED modules are operatively and securely fixed to the lighting fixture body. Each LED module comprises at least one LED, and a heat sink. The at least one LED is mounted within the LED module such that light emitted by the at least on LED is emitted in an upward direction. The heat sink is positioned such that at least a portion of the light emitted by the at least one LED is not incident upon the heat sink. Additionally, the heat sink is permanently fixed to the lighting fixture body.

19 Claims, 6 Drawing Sheets

Related U.S. Application Data continuation of application No. 14/062,572, filed on Oct. 24, 2013, now Pat. No. 10,429,052.

(51) Int. Cl.

| | |
|---|---|
| *F21W 121/00* | (2006.01) |
| *F21W 131/10* | (2006.01) |
| *F21W 131/40* | (2006.01) |

(56) References Cited

U.S. PATENT DOCUMENTS

| | | | |
|---|---|---|---|
| 7,866,850 | B2 | 1/2011 | Alexander et al. |
| 8,246,204 | B2 | 8/2012 | McCanless |
| 8,253,310 | B1 | 8/2012 | Xia |
| 8,317,366 | B2 | 11/2012 | Dalton et al. |
| 10,429,052 | B2 * | 10/2019 | Feit ..... F21V 29/70 |
| 10,711,991 | B2 | 7/2020 | Feit et al. |
| 2003/0011323 | A1 | 1/2003 | Kirkpatrick et al. |
| 2007/0242451 | A1 | 10/2007 | Richmond |
| 2010/0001662 | A1 | 1/2010 | Nelkin et al. |
| 2010/0327745 | A1 | 12/2010 | Dassanayake et al. |
| 2011/0242815 | A1 | 10/2011 | Markle et al. |
| 2012/0250302 | A1 | 10/2012 | Edwards et al. |
| 2012/0314407 | A1 | 12/2012 | Souvay et al. |
| 2013/0058087 | A1 | 3/2013 | Chang |

OTHER PUBLICATIONS

U.S. Appl. No. 14/062,572, filed Oct. 24, 2013, U.S. Pat. No. 10,429,052, Patented.

* cited by examiner

LED LIGHTING FIXTURE

CROSS-REFERENCE TO RELATED APPLICATIONS

The present application claims is a continuation of and claims priority to and the benefit of U.S. Nonprovisional patent application Ser. No. 16/545,767, filed Aug. 20, 2019 and now granted U.S. Pat. No. 10,711,991; which application is also a continuation of and claims priority to and the benefit of U.S. Nonprovisional patent application Ser. No. 14/062,572, filed Oct. 24, 2013 and now granted U.S. Pat. No. 10,429,052; the contents of all of which as are hereby incorporated by reference in their entirety.

BACKGROUND

Incandescent bulbs are slowly being phased out in favor of more efficient lighting sources. This has led to an increased use of compact fluorescent bulbs which are more efficient than incandescent bulbs, but which tend to contain dangerous gasses, such as mercury. Compact fluorescent bulbs are also affected by ambient temperature and fail reach their peak brightness in colder conditions. Additionally, many people find the color temperature of light emitted by compact fluorescents to not be aesthetically pleasing for many applications, such as household lighting in kitchens, bathrooms, and living rooms; some commercial applications; and the like. Due to the nature of compact fluorescent bulbs, the bulbs always have a frosted appearance, which also tends to reduce the aesthetic appeal of compact fluorescent bulbs. The use of halogen bulbs has also increased; however due to the high temperatures at which halogen bulbs operate they are not highly efficient and may be a fire or burn hazard.

Recent advances in manufacturing light emitting diodes (LEDs) combined with the efficiency and long lifetime of LEDs have led to an increase in the availability and affordability of LED lamps. LED lamps offer advantages over compact fluorescent bulbs including longer lifetime and the absence of dangerous gasses. Also, LED lamps may be configured to emit light at a wide variety of color temperatures.

Both incandescent bulbs and compact fluorescent bulbs emit light into a solid angle of nearly $4\pi$ steradians about the bulb. LEDs are inherently a directional light source. Moreover, because LEDs are small, solid state devices, the LEDs tend to be mounted on a circuit board or the like. This means that LED bulbs or LED luminaires tend to only emit light into a solid angle of less than $2\pi$ steradians about the bulb or luminaire. Therefore, care must be taken to mount the LED bulbs or luminaires within the lighting fixture such that the light emitted by the LEDs is emitted in a direction that is appropriate for the lighting fixture and/or application. This may result in a lighting fixture which is not aesthetically pleasing. For example, lantern style LED lighting fixtures tend to have the LEDs mounted to the top inner surface of the lighting fixture such that the light is emitted downward into the lantern. This causes the lighting fixture to have an awkward appearance. If the LEDs were simply positioned in the bottom of the fixture shining upward, this directional light beam would not provide any light below the fixture and the majority of light lost into the top of the fixture. Additionally, placing the LEDs in the bottom of the fixture shining up would not be nearly as aesthetically pleasing as the light effect obtained when using a incandescent or halogen clear light bulb.

Additionally, while LEDs are more efficient than incandescent light sources, LED light sources require a mechanism that can be used to dissipate the heat generated by the LEDs. If the heat is not efficiently dissipated, the efficiency of the LEDs or the LED light source may be compromised. Furthermore, improper heat dissipation may cause the LEDs or the LED light source to degrade prematurely.

Thus, there is a need for LED lighting fixtures which are both aesthetically pleasing and provide appropriate heat dissipation.

BRIEF SUMMARY

In various embodiments, the present invention provides a safe, simple, and aesthetically pleasing lighting fixture assembly that utilizes one or more LEDs as the light source. The lighting fixture may comprise one or more LED light engines or LED modules that are configured to efficiently dissipate the heat generated by the one or more LEDs mounted within each LED module. In various embodiments, the LED modules may be further configured to provide the look of a traditional incandescent bulb, a chandelier style or flame tip bulb, halogen bulb, and/or the like. In various embodiments, the LED modules may be an integrated part of the lighting fixture. For example, the one or more LED modules may be secured to the lighting fixture such that they are not replaceable by simply snapping on, screwing in, or in another fashion placing a replacement LED module into the fixture. For example, the LED modules may be securely and/or permanently affixed to the lighting fixture. In another example, the LED modules may be hard-wired into the lighting fixture. In other examples a portion of the LED module (e.g., the heat sink) may be an integrated into the lighting fixture, while other portions of the LED module (e.g., the LEDs, secondary optics, and/or the like) may not be integrated into the lighting fixture. For example, in one embodiment, the heat sink is integrated into the lighting fixture, however, an optical unit comprising at least one LED and fixed secondary optics may be removably secured to the lighting fixture.

In various embodiments, the lighting fixture comprises a fixture mounting component which can be mounted on a wall or ceiling or other surface or can be configured to rest upon a desk or table or the floor, or the like. In other various embodiments, the lighting fixture may be configured to be held in a user's hand. In various embodiments, the fixture mounting may contain at least one LED module. In various embodiments, the LED module may be configured to look like an incandescent bulb. Particularly, the LED module may be configured to look like a traditional incandescent bulb or a decorative incandescent bulb such as a "flame-shaped" or flame tip bulb, other shaped bulb, and/or the like. In various embodiments, the LED module is an integrated part of the lighting fixture, rather than a simple bulb In various embodiments, a light emitting diode (LED) lighting fixture is provided. The LED lighting fixture may comprise a lighting fixture body and at least one LED module. Each LED module comprises one or more LEDs and an optical assembly. The optical assembly is configured to give the LED module an appearance that emulates the appearance of an incandescent bulb. Moreover, the at least one LED module is operatively and fixedly secured to the lighting fixture body.

In various embodiments, a light emitting diode (LED) lighting fixture is provided. The LED lighting fixture comprises a lighting fixture body and one or more LED modules operatively and securely fixed to the lighting fixture body.

Each LED module may comprise at least one LED, and a heat sink. The at least one LED may be mounted within the LED module such that light emitted by the at least one LED is emitted in an upward direction. Additionally, the heat sink may be positioned such that at least a portion of the light emitted by the at least one LED is not incident upon the heat sink.

In various embodiments, a method of manufacturing a light emitting diode (LED) lighting fixture is provided. The method may comprise providing a lighting fixture body and operatively and securely fixing one or more LED modules to the lighting fixture body. Each LED module may comprise at least one LED, and a heat sink. The at least one LED may be mounted within the LED module such that light emitted by the at least one LED is emitted in an upward direction. Additionally, the heat sink may be positioned such that at least a portion of the light emitted by the at least one LED is not incident upon the heat sink. In various embodiments, securely fixing the one or more LED modules to the lighting fixture body comprises permanently fastening the one or more LED modules to the lighting fixture body. In various embodiments, operatively fixing the one or more LED modules to the lighting fixture body comprises hard-wiring an electrical component of each LED module to an electrical supply component associated with the lighting fixture body. In various embodiments, the method may further comprise hard-wiring at least one driver circuit configured to control a current flowing through the at least one LED to an electrical supply component associated with the lighting fixture body. In various embodiments, the LED module is configured to emulate the aesthetic appearance of a traditional or decorative incandescent bulb. In various embodiments, the LED module is configured to emulate the aesthetic appearance of a chandelier or flame tip PR halogen incandescent bulb.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 5:
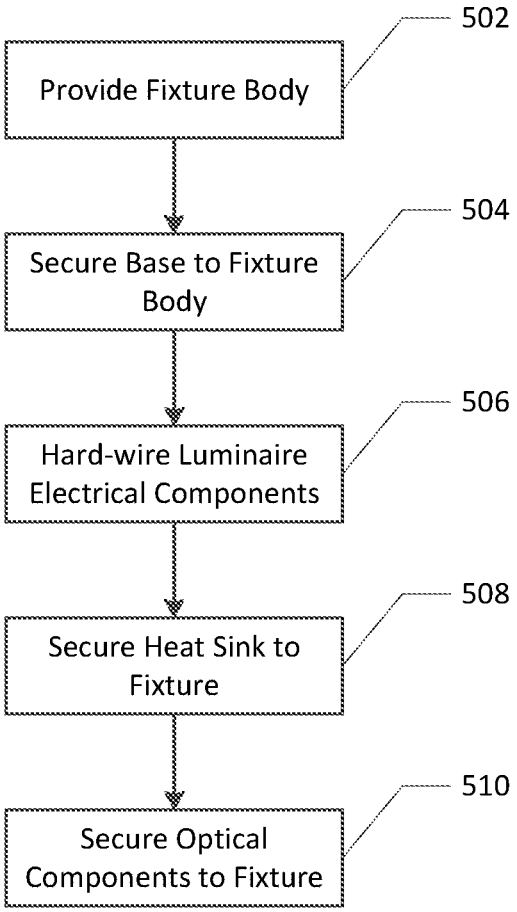
Figure 6:
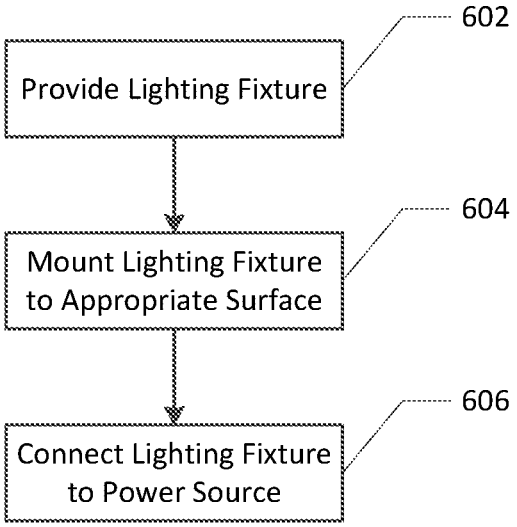

FIG. 5 provides a flowchart of one method of manufacturing an LED lighting fixture, according to one embodiment of the present invention; and FIG. 6 provides a flowchart of one method of installing an LED lighting fixture, according to one embodiment of the present invention.

DETAILED DESCRIPTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
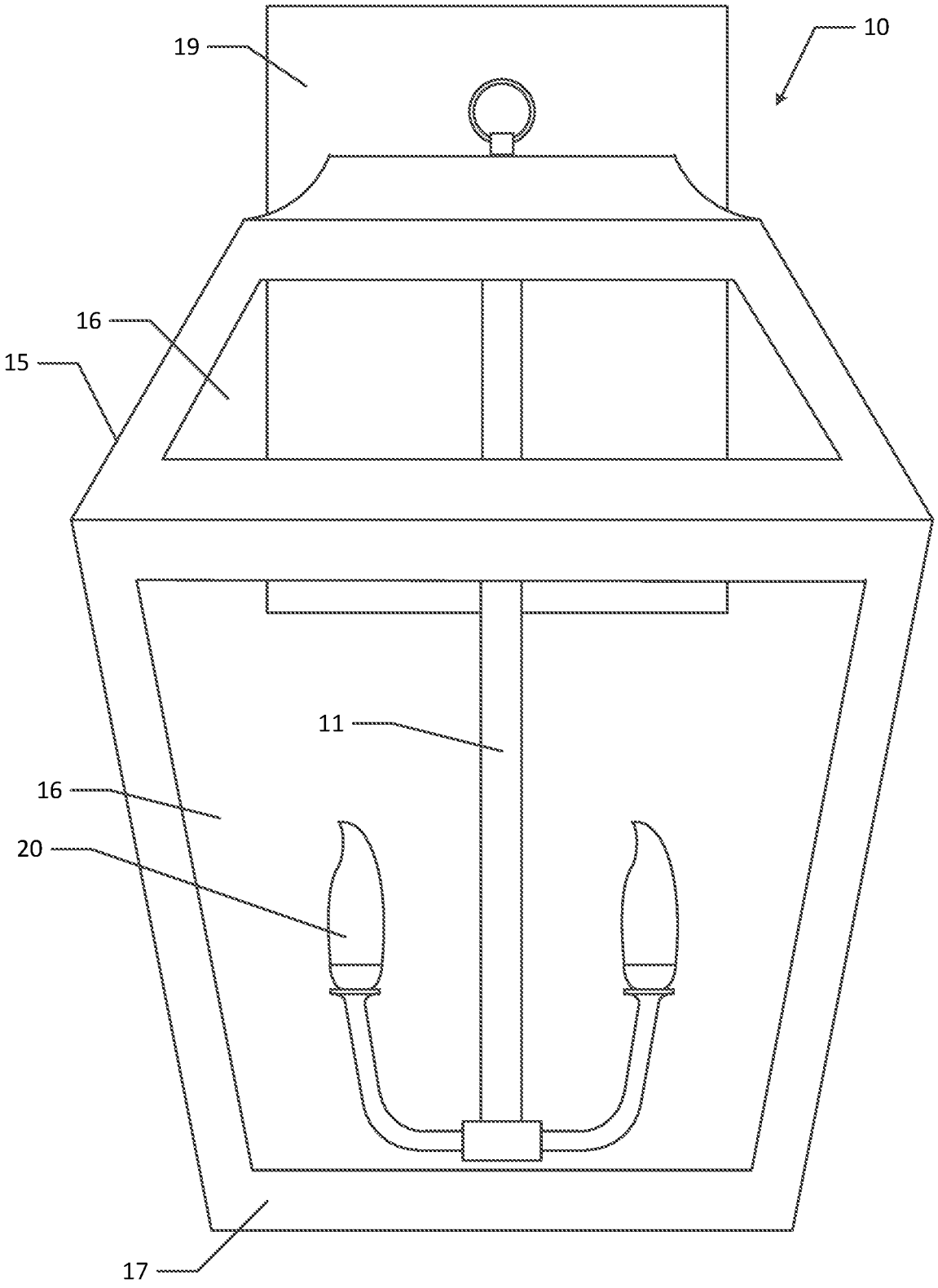
FIG. 1 is a front view of an LED lighting fixture, according to one embodiment of the present invention.
Figure 2:
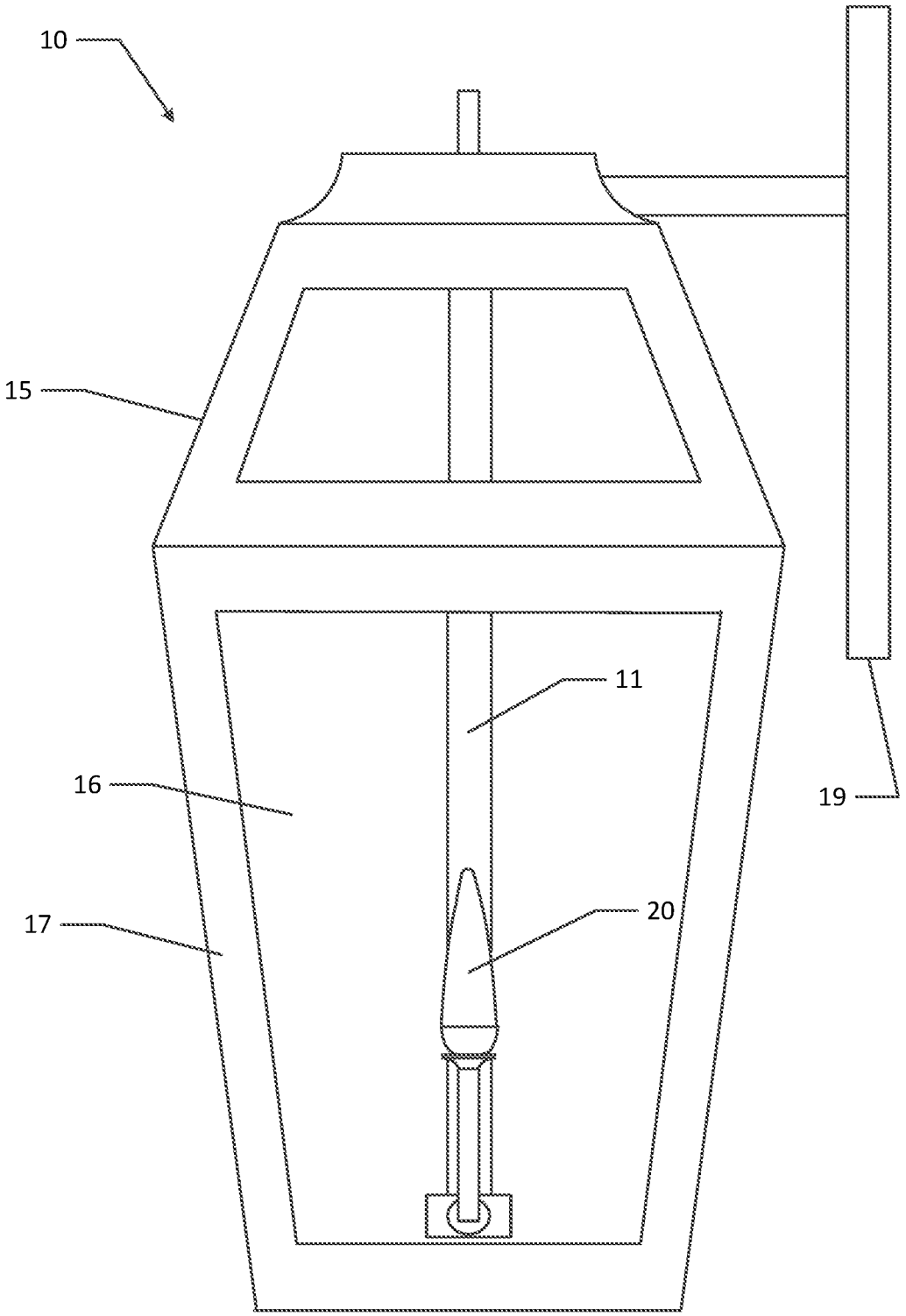
FIG. 2 is a side view of the lighting fixture illustrated in FIG. 1.
Figure 3:
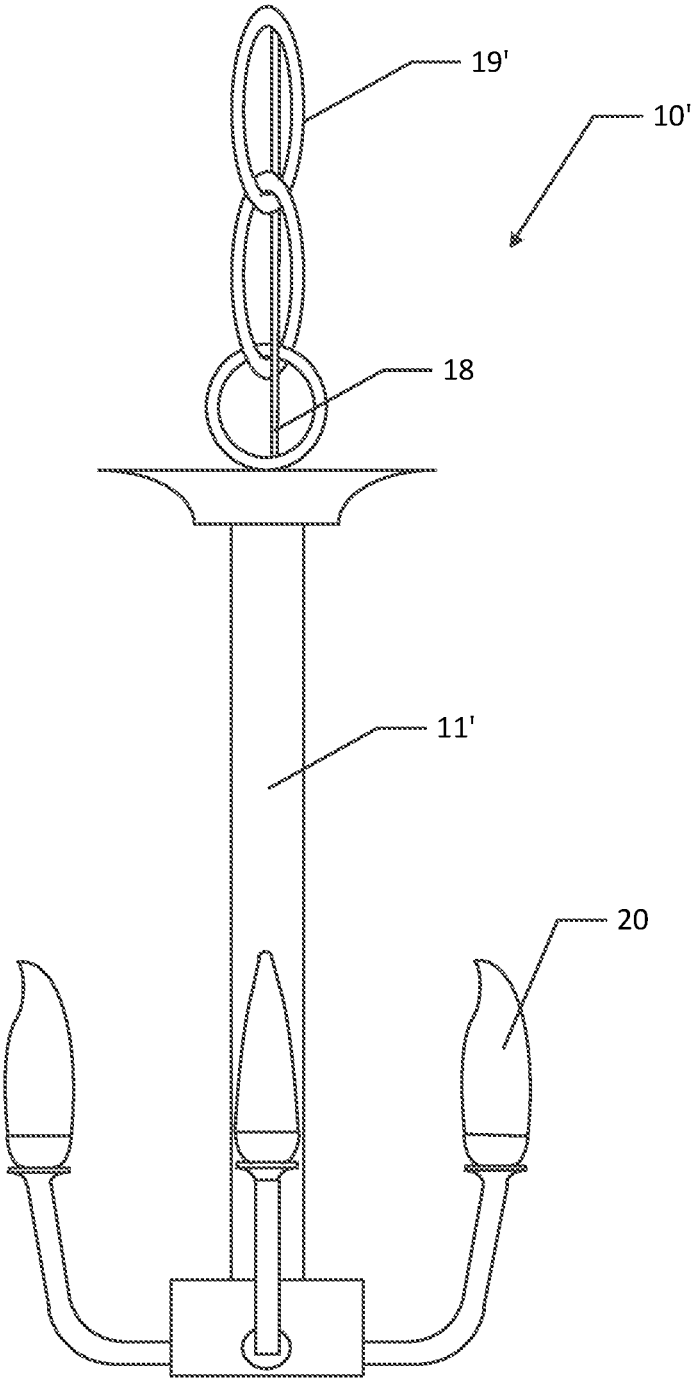
FIG. 3 is a side view of another embodiment of the present invention.

FIGS. 1, 2 and 3 show various embodiments of LED lighting fixtures 10 and 10', according to various embodiments of the present invention. FIGS. 1 and 2 illustrate an indoor/outdoor lantern style LED lighting fixture 10 and FIG. 2 illustrates a chandelier style LED lighting fixture 10'. In various embodiments, the LED lighting fixture 10, 10' may be configured for indoor use, outdoor use, or indoor/outdoor use.

Lighting Fixture 10

As shown in FIGS. 1 and 2, a lantern style LED light fixture 10 may comprise a mounting panel 19, a decorative housing 15, an LED module support 11, and at least one LED module 20. The mounting panel 19 may be configured to mount the lighting fixture 10 to a wall, ceiling, table top and/or other surface. The mounting panel 19 illustrated in FIGS. 1 and 2 is configured to mount the lighting fixture 10 to a wall or other substantially vertical surface. The mounting panel 19 may also be configured to hide the wires used to electrically connect the lighting fixture 10 to a power source. The decorative housing 15 illustrated in FIGS. 1 and 2 comprises a housing frame 17 and panels 16 disposed within the housing frame 17. The housing frame 17 may be configured to provide structural support for the decorative housing 15. In various embodiments, the panels 16 are configured to allow at least a portion of the light emitted by the LED modules 20 to pass through the panels 16. It should be understood that the decorative housing 15 may be configured in a variety of ways such that lighting fixtures may be provided in a variety of styles. The LED module support 11 is configured to provide structural support for one or more LED modules 20. For example, as shown in FIGS. 1 and 2, the LED module support 11 is configured to suspend the LED modules 20 within the decorative housing 15. The LED module support 11 may be further configured hide and/or disguise the wires used to provide electrical power to the one or more LED modules 20. The LED module support 11 may also be configured to add a decorative aspect to the lighting fixture 10. In various embodiments, the LED module support 11 and/or housing frame 17 may be made of metal, plastic, wood, and/or any other suitable material. In various embodiments, the panels 16 may be made of semi-translucent plastic, transparent plastic, glass, frosted glass, and/or the like as appropriate for the application.

Lighting Fixture 10'

FIG. 3 illustrates a chandelier style LED lighting fixture 10'. The lighting fixture 10' comprises mounting component 19', LED module support 11', and one or more LED modules 20. In the embodiment illustrated in FIG. 3, the mounting component 19' comprises a chain that may be used to mount the chandelier style LED lighting fixture 10' to a ceiling or other overhead surface. The mounting component 19' may be configured to hide and/or add a decorative aspect to the power wire 18, which is configured to connect the lighting fixture 10' to an electrical power source. In one embodiment, the LED module support 11' comprises a battery compartment for housing one or more batteries for powering the lighting fixture 10'; in this embodiment the power wire 18 may be completely hidden within the LED module support 11'. The LED module support 11' is configured to provide structural support for the one or more LED modules 20.

Thus, in the embodiment illustrated in FIG. 3, the LED module support 11' provides the body of the lighting fixture. The LED module support 11' may be further configured to provide a decorative aspect to the lighting fixture 10' and/or to hide or disguise the wires used to provide electrical power to the one or more LED modules 20.

LED Module 20

Figure 4:
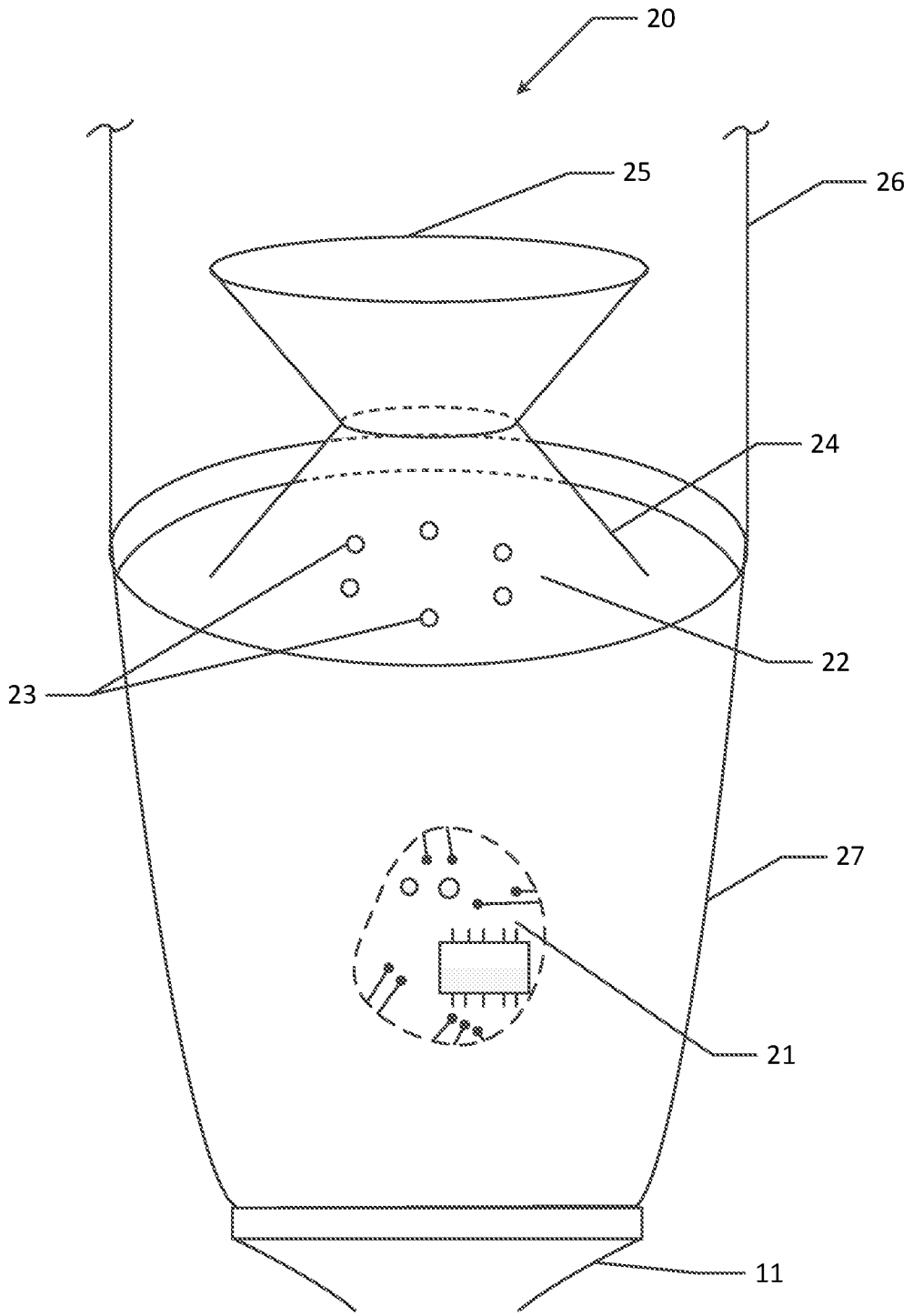
FIG. 4 is a close up view of a luminaire, according to one embodiment of the present invention.

Each lighting fixture 10, 10' includes one or more LED modules 20. FIG. 4 provides a close up of a LED module 20, according to one embodiment of the present invention. In various embodiments, at least one LED 23 may be secured in each LED module 20. It should be noted that the present invention allows for the at least one LED to be mounted within the LED module such that light is emitted up into the lighting fixture, similar to traditional incandescent bulb lighting fixtures.

Any circuitry necessary to operate the one or more LEDs 23 may be mounted within the base 27 according to various embodiments. In various embodiments, the at least one LED 23 may be an alternating current (AC) driven LED. In other embodiments, the at least one LED 23 may be a direct current (DC) driven LED. In some embodiments, no driver circuitry is necessary to operate the one or more LEDs 23. In other embodiments, one driver circuit 21 may operate all the LEDs 23 present in lighting fixture 10, 10'. In some such embodiments, the driver circuit 21 may be disposed within the LED module support 11, 11' rather than in a base 27. In still other embodiments, multiple driver circuits 21 may be used to operate the at least one LED 23 mounted within each LED module 20. In some such embodiments a driver circuit 21 may be mounted in each LED module 20.

In various embodiments, the driver circuit 21 may comprise a circuit portion configured to convert AC voltage into DC voltage. In some embodiments, the driver circuit 21 may comprise a circuit portion configured to control the current flowing through the one or more LEDs 23. In certain embodiments, the driver circuit 21 may comprise a circuit portion configured to dim the lighting fixture 10, 10'. In various embodiments, additional circuit components may be present in the driver circuit 21. Similarly, in various embodiments, all or some of the circuit portions mentioned here may not be present in the driver circuit 21. In some embodiments, circuit portions listed herein as separate circuit portions may be combined into one circuit portion. As should be appreciated, a variety of driver circuitry configurations are generally known and understood in the art and any of such may be employed in various embodiments as suitable for the intended application, without departing from the scope of the present invention.

The at least one LED 23 may be of various color temperatures or various colors. In various embodiments, the at least one LED 23 may be white LEDs. In other embodiments, at least one of the at least one LEDs 23 may be a colored LED, such as a red, blue, green, or other colored LED. In various embodiments, different LEDs 23 secured within the same LED module 20 may have different color temperatures. In other embodiments, all LEDs 23 in the lighting fixture 10, 10' are designed to have approximately the same color temperature. In still other embodiments, the at least one LED 23 mounted in one LED module 20 may be a different color temperature than the at least one LED 23 mounted in a different LED module 20. For each embodiment, the color temperature of the one or more LEDs 23 may be chosen as appropriate for the expected use of lighting fixture 10, 10'.

In various embodiments, the at least one LED 23 may be mounted on a board 22 by any suitable method commonly known and understood in the art. In some such embodiments, any driver circuit 21 present may also be mounted on the board 22. In some embodiments, 21 or more LEDs may be mounted on a board 22. In other embodiments, no more than 5 LEDs are mounted on a board 22. In other embodiments, six to fifteen LEDs 23 may be mounted on a board 22. In yet other embodiments, sixteen to twenty LEDs 23 may be mounted on a board 22. In the embodiment shown in FIG. 4, six LEDs 23 are mounted on the board 22 within each LED module 20.

In various embodiments, the board 22 may be made of a reflective material. In other embodiments, the board 22 may be coated with a reflective material. Therefore, at least some portion of the light emitted from the at least one LED 23 in the direction of the board 22 or light that has been reflected back at the board 22 will be reflected off of the board 22. In various embodiments, the board 22 may be configure to act as a heat sink or as part of a heat sink configured to dissipate the heat generated by the at least one LED 23 mounted in the LED module 20.

In various embodiments, a board 22 is secured into a base 27. In various such embodiments, at least one LED 23 is mounted on the board 22. In various embodiments, driver circuit 21 may also be mounted to the board 22. In some such embodiments, the driver circuit 21 may be mounted on the opposite side of the board 22 than the side on which the at least one LED 23 is mounted. In some embodiments, the board 22 may be closed into the base 27 by a lens 25 and/or secondary optics 26 disposed on top of the at least one LED 23 and board 22 in the LED module 20. In other embodiments, the board 22 may be mounted into base 27 via an appropriate adhesive. In yet other embodiments, the board 22 may be mounted into base 27 by other suitable mechanisms. In various embodiments the board 22 may be recessed into the base 27. For example, the board 22 may be configured to be recessed a quarter of an inch, an eighth of an inch, or a sixteenth of an inch in the base 27. In other embodiments, the board 27 may be configured to be flush with the edge of the base 27. In various embodiments, the board 22 may be recessed within the base 27 as appropriate for the target aesthetic appearance of the lighting fixture 10, 10'.

As noted above, each LED module 20 comprises a base 27. In various embodiments, the base 27 may be configured to be approximately the same size as a traditional E26, E12, GU24, or other traditional bulb base. In other embodiments, the base 27 may be configured to be a size different from a traditional bulb base size. In some embodiments, the base 27 is integrally formed with the LED module support 11, 11'. Thus, the LED module 20 may be an integral portion of the lighting fixture 10, 10'. In other embodiments, the base 27 may not be integrally formed with the LED module support 11, 11', but is securely fixed to the LED module support 11, 11'. Thus, the LED module 20 may be securely connected to the lighting fixture 10, 10' such that the electrical components of LED module 20 are hard-wired into the lighting fixture 10, 10'. The base 27 may house driver circuitry 21. Thus, any circuitry necessary to operate the one or more LEDs 23 may be mounted within the base 27 according to various embodiments. The board 22 and/or at least one LED 23 may also be mounted within the base 27. As the LED module is hard-wired into the lighting fixture 10, 10', there is no need to use a thermal dissipation design of an adapter or tower or the like to dissipate the heat generated by the at least one LED 23 mounted within the LED module 20.

Rather at least a portion of the LED module support 11, 11' and/or a portion of the LED module 20 may be configured to dissipate the heat generated by the at least one LED 23. In various embodiments, the base 27 may be further configured to dissipate heat generated by the at least one LED 23 mounted within the base 27 and/or within the LED module 20.

In various embodiments, a lens 24 may also be mounted within the LED module 20. In some embodiments, a lens 24 may be mounted over the at least one LED 23. The lens 24 may be configured to enclose the at least one LED 23 within the LED module 20. In such embodiments, the lens 24 may be mounted in the base 27 such that the at least one LED 23 is enclosed within the base 27 of the LED module 20. In various embodiments, the lens 24 may be configured to refract, direct, focus, spread, and/or otherwise condition the light emitted by the at least one LED 23 mounted within the LED module 20. Thus, the lens 24 may be configured to allow at least a fraction of the light emitted by the at least one LED 23 mounted within the LED module 20 to pass through the lens 24. In various embodiments, the lens 24 may be made of plastic, glass, or some other at least semi-translucent material.

In various embodiments, the LED module 20 may further comprise secondary optics 25. In the embodiment illustrated in FIG. 4, the secondary optics 25 may comprise a secondary optics disk and/or light spreader disk that is suspended over the at least one LED 23 and/or lens 24. The secondary optics 25 may be configured to reflect, direct, focus, disperse, refract, and/or otherwise condition the light emitted by the at least one LED 23 within the LED module 20. Thus, the secondary optics 25 may be configured to give the LED module 20 the look of a traditional light bulb. For example, the secondary optics 25 may be configured to emulate the decorative effect and light spread from an incandescent PR halogen light bulb or other incandescent and/or decorative bulb. In various embodiments, the secondary optics 25 may be etched in order to refract, focus, and/or spread the light emitted by the at least one LED 23 mounted in the LED module 20 in various ways, as appropriate for the application. In various embodiments, the secondary optics 25 may be made of plastic, glass, some other at least semi-translucent material, or a reflective material.

In various embodiments the lens 24 and/or the secondary optics 25 may be permanently mounted over the at least one LED 23 mounted within the LED module 20. In some such embodiments, the lens 24 may be securely fixed between the secondary optics 25 and the at least one LED 23. In some embodiments, the lens 24 and the secondary optics 25 are integrally formed. In various embodiments, the lens 24 and the secondary optics 25 may be made of the same or different material.

In various embodiments, a heat sink may be mounted directly below the optical components (e.g., LEDs 23, lens 24, secondary optics 25, and/or the like) of the LED module 20. In various embodiments, the heat sink is fixed and is an integral part of the lighting fixture 10, 10'. For example, the heat sink may be a part of the lighting fixture 10, 10' or otherwise fixed to the lighting fixture 10, 10' and/or within the LED module 20 such that the heat sink is not removable. In such embodiments, the heat sink may be integrally formed with the lighting fixture 10, 10' or may be securely adjoined to the lighting fixture 10, 10'. The heat sink may be raised and/or otherwise configured such that the LED module 20 may aesthetically emulate the size of a traditional incandescent, halogen or LED chandelier or flame tip bulb. In various embodiments, the heat sink may comprise the board 22 and/or base 27. In some embodiments, a self-contained driver circuit 21 may be mounted to and/or embedded in the heat sink.

The LED module 20 may further comprise a bulb 26. The bulb 26 may be configured to enclose the secondary optics 25 and the lens 24 within the LED module 20. In some embodiments, the bulb 26 is configured to provide a decorative quality to the LED module 20. The bulb 26 may be further configured to provide the look of a traditional incandescent bulb. For example, the bulb 26 may be configured to provide the LED module 20 with the look of a traditional chandelier bulb, a flame shaped bulb, and/or the like. In some embodiments, especially embodiments configured for outdoor or indoor/outdoor use, the bulb 26 may act to seal the LED module 20 to protect the at least on LED 23, lens 24, secondary optics 25, and/or the like from humidity, rain, dust, and/or the like. The bulb 26 may further act to electrically and/or physically isolate the user from the electrical components of the lighting fixture 10, 10'.

In various embodiments, the lens 24, secondary optics 25, bulb 26, and/or other optical component may comprise an optical assembly. In various embodiments, the may be integrally formed. In other embodiments the lens 24, secondary optics 25, and/or bulb 26 may be separately formed of the same or different material. Thus, the lens 24, secondary optics 25, and/or bulb 26 may be made of glass, a polymerized material, smart glass or some other material that can transition from clear to frosted and/or vice versa, and/or other acceptable materials commonly known and understood in the art.

As noted above, in various embodiments, the at least one LED 23, lens 24, secondary optics 25, and/or bulb 26 may be permanently fixed to the LED module 20 and/or the lighting fixture 10, 10'. Thus, the entire LED module 20 may be integrated into the lighting fixture 10, 10'. In one embodiment, a portion of the LED module 20 may be removably mounted to the lighting fixture 10, 10'. For example, an optics module comprising at least one LED 23, the lens 24, the secondary optics 25, and/or the bulb 26 may be configured to snap or screw onto the base 27, or otherwise be replaced. However, the heat sink portion of the LED module 20 may not be removable from the lighting fixture 10, 10' or secured to the lighting fixture 10, 10' such that it may be difficult to remove. Thus, in embodiments in which an optics module may be removably mounted to the lighting fixture 10, 10', the optics module need not comprise a heat sink portion.

As discussed above and as illustrated in FIGS. 1-3, various embodiments of an LED lighting fixture 10, 10' may comprise two or more LED modules 20. In various such embodiments, a board 22 and/or other heat sink may be fixedly mounted into each LED module 20. In some such embodiments, at least one LED 23 is mounted on each board 22. In various embodiments, at least one LED 23 may be operatively mounted in each LED module 20, as may be desirable for particular applications. Additionally, a lens 24, secondary optics 25, and/or other optical components may be fixedly mounted within each LED module 20 to focus, spread, refract and/or otherwise condition the light emitted by the at least one LED 23 mounted within the LED module 20.

Method of Manufacturing a Lighting Fixture 10, 10'

FIG. 5 provides a method by which a lighting fixture 10, 10' may be manufactured, according to one embodiment of the present invention. At step 502, a fixture body, (e.g., LED module support 11, 11', decorative housing 15, wiring, such as power cord 18 or the like, configured to provide electrical power to the one or more LED module s 20, and/or the like) may be provided. The lighting fixture body may include various decorative aspects. For example, the lighting fixture body may be a chandelier or lantern style lighting fixture body.

If the base 27 is not integrally formed with the fixture body, the base 27 may be securely fixed to the fixture body at step 504. The electrical components of LED module 20 (e.g., driver circuit 21 and/or the at least one LED 23) may be hard-wired to the electrical components of the fixture body at step 506. For example, the at least one LED 23 and/or driver circuit 21 may be hard-wired to the electrical components of the fixture body.

If the heat sink is not integrally formed with the fixture body and/or the base 27, the heat sink may be securely fixed to the fixture body and/or the base 27 at step 508. In various embodiments, securely fixing the heat sink to the fixture body and/or the base 27 may comprise permanently fixing the heat sink to the fixture body and/or the base 27 via any appropriate method commonly known in the art. In some embodiments, this step may comprise securely fastening the board 22 into the base 27.

At step 510 the optical components (e.g., the at least one LED 23, lens 24, and/or secondary optics 25, bulb 26 and/or the like) are securely fixed to the lighting fixture body, base 27, and/or board 22. In various embodiments, securely fixing the optical components to the lighting fixture body, base 27, and/or board 22 may comprise permanently fixing the optical components to the lighting fixture body, base 27, and/or board 22, via any appropriate method commonly known in the art.

Method of Installing a Lighting Fixture 10, 10'

FIG. 6 illustrates one method of installing a lighting fixture 10, 10', in accordance with an embodiment of the present invention. At step 602 a lighting fixture 10, 10' is provided. The lighting fixture 10, 10' may comprise a LED module support 11, 11', a decorative housing 15, one or more LED modules 20, and/or wiring (e.g., power cord 18 or the like) configured to provide electrical power to the one or more LED modules 20. For each LED module 20, an integrated heat sink may be provided as part of the lighting fixture 10, 10'. In various embodiments, the integrated heat sink may be located directly under the optical components (e.g., LEDs 23, lens 24, secondary optics 25, and/or bulb 26) of each LED module 20.

The lighting fixture 10, 10' may further comprise a mounting component 19, 19'. At step 604, the mounting component 19, 19' may be used to mount the lighting fixture 10, 10' to an appropriate surface. For example, in some embodiments, the lighting fixture 10, 10' may be configured to be mounted on a substantially vertical surface (e.g., a wall). In other embodiments, the lighting fixture 10, 10' may be configured to be mounted from a substantially horizontal surface (e.g., a table, desk, or ceiling). In some embodiments, the lighting fixture 10, 10' may be mounted by placing it on a substantially horizontal surface (e.g., a desk, table, floor, or the like). In other embodiments, mounting the lighting fixture 10, 10' may comprise screwing, bolting, and/or otherwise securing the lighting fixture 10, 10' to an appropriate surface (e.g., wall, ceiling, and/or the like).

As noted above, the lighting fixture 10, 10' may comprise wiring configured to provide electrical power to the one or more LED modules 20. The wiring may be hidden and/or decoratively disguised within the LED module support 11, 11' and/or other component of the lighting fixture 10, 10'. The wiring may be configured to operatively connect the electrical components of each LED module 20 to the power cord 18. At step 606, the power cord 18 may be operatively connected to a power source. For example, in one embodiment, the power cord 18 may be operatively connected to line voltage via a direct connection, a quick connect connection, a polarized plug, and/or the like. In another example, the power cord 18 may be operatively connected to a battery or other power source.

After the one or more LED modules 20 are operatively connected to a power source, via the power cord 18 and/or the like, the one or more driver circuits 21 may be used to operate the at least one LED 23 mounted within each LED module 20. As noted above, a driver circuit 21 may be mounted within the lighting fixture 10, 10' such that the at least one LED 23 of each LED module 20 is operated by the same driver circuit 21. In other embodiments, a driver circuit 21 may be mounted within each LED module 20 for controlling the current flowing through the at least one LED 23 of that LED module 20. Additionally, the lighting fixture 10, 10' may be operatively connected to any of a variety of switches and dimmers commonly known in the art that may be configured to control the flow of current to the one or more driver circuits 21 of the lighting fixture 10, 10'.

Conclusion

Many modifications and other embodiments of the invention set forth herein will come to mind to one skilled in the art to which these inventions pertain having the benefit of the teachings presented in the foregoing descriptions and the associated drawings. Therefore, it is to be understood that the invention are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A light emitting diode (LED) module comprising:
- a raised base;
- one or more LEDs;
- an optical assembly consisting of:
  - a lens,
  - a light spreader disk, and
  - a bulb,
  - wherein:
    - the lens is securely fixed directly to the light spreader disk and positioned between the light spreader disk and the one or more LEDs, such that at least a portion of the light emitted by the one or more LEDs is incident upon the light spreader disk and the bulb is an envelope of the LED module, and
    - the optical assembly is removably mounted to the raised base, such that the optical assembly is independently replaceable with another optical assembly; and
- a board, said one or more LEDs being fixedly mounted to said board and said board being mounted to a surface of said raised base,
- wherein;
  - the mounting of the board on the surface of said raised base places said one or more LEDs in a raised position within the LED module, and the optical assembly is separate from said one or more LEDs.

2. The LED module of claim 1, wherein the LED module is configured to emulate the aesthetic appearance of one of a clear light bulb, a chandelier light bulb, a flame tip light bulb, a G lamp bulb, or an incandescent bulb having a filament.

3. The LED module of claim 1, wherein said light spreader disk is positioned such that at least a portion of the light emitted by the one or more LEDs is emitted toward the light spreader disk.

4. The LED module of claim 3, wherein the light spreader disk is etched.

5. The LED module of claim 1, wherein said one or more LEDs are operatively and fixedly mounted into thermally conductive communication with at least one heat sink, said board providing at least a portion of a thermally conductive and electrically isolated path for said thermally conductive communication.

6. A modular assembly comprising:

one or more LED modules each comprising at least one LED, a board, and a raised base, the at least one LED being operatively mounted to the board; and an optical assembly corresponding to and separate from each of the one or more LED modules, each optical assembly consisting of:

a lens, a light spreader disk, and a bulb, wherein the lens is securely fixed to the light spreader disk and positioned between the light spreader disk and the at least one LED such that at least a portion of the light emitted by the at least one LED is incident upon the light spreader disk and the bulb is an envelope of the LED module, and wherein:

the board is mounted to said raised base, wherein the mounting of the board on said raised base places said at least one LED in a raised position within the one or more LED modules, and the optical assembly is separate from said at least one LED.

7. The modular assembly of claim 6, wherein at least a portion of said one or more LED modules is integrally formed with a lighting fixture body.

8. The modular assembly of claim 7, wherein the lighting fixture body comprises a decorative housing such that said one or more LED modules are contained within said decorative housing.

9. The modular assembly of claim 7, wherein said lighting fixture is a chandelier or lantern style lighting fixture.

10. The modular assembly of claim 7, wherein said lighting fixture is configured for indoor or outdoor use.

11. The modular assembly of claim 6 wherein said LED module is configured to emulate a decorative effect and light spread from a traditional or decorative incandescent or halogen bulb.

12. The modular assembly of claim 6, further comprising a heat sink, wherein:

at least a portion of said one or more LED modules is integrally formed with a lighting fixture body;

said heat sink is permanently fixed to said lighting fixture body; and said at least one LED is securely mounted into said lighting fixture such that the at least one LED is fixedly mounted into thermally conductive communication with the heat sink, said board providing at least a portion of a thermally conductive and electrically isolated path for said thermally conductive communication.

13. The modular assembly of claim 6, wherein said light spreader disk is positioned such that at least a portion of light emitted by said at least one LED is emitted toward said light spreader disk.

14. The modular assembly of claim 13, wherein said light spreader disk is etched.

15. The modular assembly of claim 6, further comprising at least one driver circuit component, wherein said driver circuit component is configured to control a current flowing through said at least one LED.

16. The modular assembly of claim 15, wherein said at least one driver circuit is hard-wired into a lighting fixture.

17. At least one LED module, each LED module comprising:

a raised base;

one or more LEDs;

an optical assembly separate from said one or more LEDs and consisting of: a lens, a light spreader disk, and a bulb; and a board, said one or more LEDs being mounted to said board and said board being mounted to a portion of said raised base, wherein:

the mounting of the board on the portion of said raised base places said one or more LEDs in a raised position within the LED module; and the optical assembly is removably mounted over and separate from said one or more LEDs.

18. The at least one LED module of claim 17, wherein each LED module is configured to emulate a decorative effect and light spread from a traditional or decorative incandescent or halogen bulb.

19. The at least one LED module of claim 17, wherein said light spreader disk is etched and positioned such that at least a portion of the light emitted by the at least one LED is emitted toward the light spreader disk.

* * * * *